US010238169B2

(12) United States Patent
Kilgore et al.

(10) Patent No.: US 10,238,169 B2
(45) Date of Patent: Mar. 26, 2019

(54) ARTICLE OF FOOTWEAR WITH ROD SUPPORT SYSTEM

(71) Applicant: NIKE, Inc., Beaverton, OR (US)

(72) Inventors: Bruce J. Kilgore, Lake Oswego, OR (US); Paul J. Francis, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 92 days.

(21) Appl. No.: 15/414,657

(22) Filed: Jan. 25, 2017

(65) Prior Publication Data

US 2017/0127752 A1 May 11, 2017

Related U.S. Application Data

(62) Division of application No. 14/551,194, filed on Nov. 24, 2014, now Pat. No. 9,615,624.

(51) Int. Cl.

| | |
|---|---|
| ***A43B 13/14*** | (2006.01) |
| ***A43B 7/14*** | (2006.01) |
| ***A43B 21/30*** | (2006.01) |
| ***A43B 21/26*** | (2006.01) |
| ***A43B 7/28*** | (2006.01) |

(52) U.S. Cl.

CPC ..... *A43B 7/1495* (2013.01); *A43B 7/28* (2013.01); *A43B 13/141* (2013.01); *A43B 21/26* (2013.01); *A43B 21/30* (2013.01)

(58) Field of Classification Search

CPC ..... A43B 7/1495; A43B 7/28; A43B 13/141; A43B 21/26; A43B 21/30

See application file for complete search history.

(56) References Cited

U.S. PATENT DOCUMENTS 2,097,958 A * 11/1937 Uger ..... A43B 7/142 36/180
2,746,174 A * 5/1956 Patterson, Jr. ..... A43B 5/18 36/100
2,746,178 A * 5/1956 Miller ..... A43B 13/41 36/58.5
3,039,207 A * 6/1962 Lincors ..... A43B 13/18 36/58.5
3,133,544 A * 5/1964 Coplans ..... A43B 7/1495 36/170
3,323,232 A * 6/1967 Danowsky ..... A43B 7/1495 36/76 R
3,928,927 A * 12/1975 Brown ..... A43B 3/122 12/142 S
4,887,833 A * 12/1989 Bailey ..... A43B 5/0492 280/615
5,291,671 A * 3/1994 Caberlotto ..... A43B 5/00 36/114

(Continued)

*Primary Examiner* — Jila M Mohandesi
(74) *Attorney, Agent, or Firm* — Quinn IP Law

(57) ABSTRACT

An article of footwear has a sole with a forefoot portion, a midfoot portion, and a heel portion. The sole has a ground-facing side and a foot-facing side opposite the ground-facing side. The article of footwear includes a support system that has one or more rods spaced from the sole and extending longitudinally from the forefoot portion to the heel portion on the foot-facing side. The rod is operatively connected to the sole at the forefoot portion and at the heel portion. A sling is suspended from the rod over the midfoot portion. The rod bends when the sole is flexed to thereby lift the sling away from the sole.

20 Claims, 6 Drawing Sheets

(56) References Cited

U.S. PATENT DOCUMENTS 6,082,768 A * 7/2000 Johnson ..... A63C 17/045
280/11.3
8,857,077 B2 * 10/2014 Kahatsu ..... A43B 3/26
36/113

* cited by examiner

ARTICLE OF FOOTWEAR WITH ROD SUPPORT SYSTEM

CROSS-REFERENCE TO RELATED APPLICATION

This a divisional application of U.S. patent application Ser. No. 14/551,194, filed on Nov. 24, 2014, the entire disclosure of which is incorporated by reference herein.

TECHNICAL FIELD

The present disclosure relates to an article of footwear that has a rod with a sling that supports and lifts a foot above the sole.

BACKGROUND

Footwear typically includes a sole configured to be located under a wearer's foot to space the foot away from the ground or floor surface. Soles can be designed to provide a desired level of cushioning. Athletic footwear in particular sometimes utilizes polyurethane foam, rubber, or other resilient materials in the sole to provide cushioning and support for the foot below the foot.

DETAILED DESCRIPTION

Figure 1:
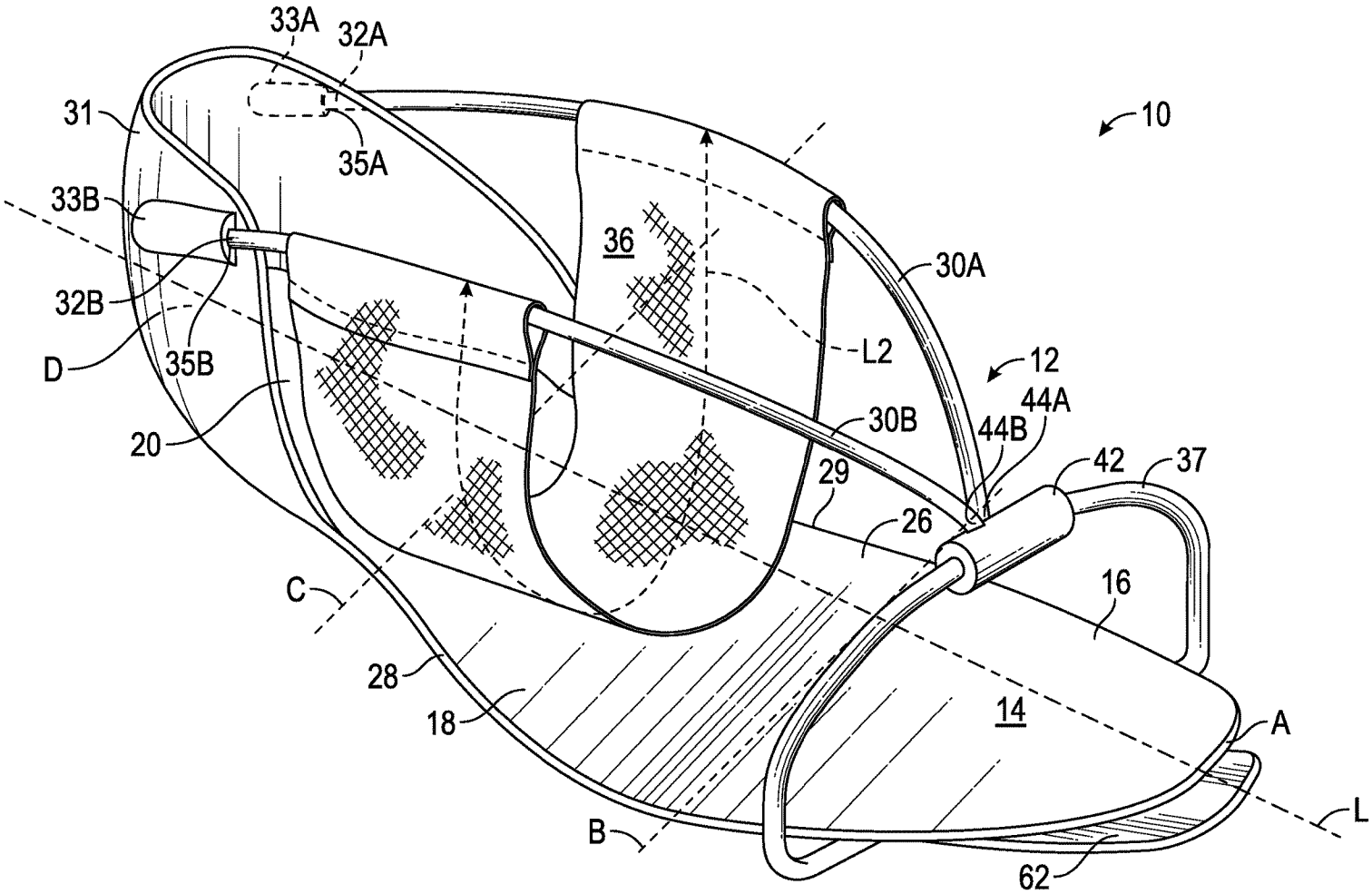
FIG. 1 is a schematic illustration in perspective view of a first embodiment of an article of footwear.

An article of footwear includes a sole having a forefoot portion, a midfoot portion, and a heel portion. The sole has a ground-facing side and a foot-facing side opposite the ground-facing side. The article of footwear includes a support system that supports the foot from above the sole. The support system has a rod spaced from the sole that extends longitudinally from the forefoot portion to the heel portion on the foot-facing side. The rod is operatively connected to the sole at the forefoot portion and at the heel portion. A sling is suspended from the rod over the midfoot portion. The rod bends when the sole is flexed to thereby lift the sling away from the sole.

The rod is in a first configuration when the sole is in an unflexed state, and elastically deforms to a second configuration bent relative to the first configuration when the sole is in a flexed state. In the flexed state, the heel portion is closer to the forefoot portion on the foot-facing side than in the unflexed state. The rod is biased to return to the first configuration, thereby releasing stored spring energy when the sole moves from the flexed state to the unflexed state.

For example, the sole moves from the flexed state to the unflexed state when the sole makes contact with a ground plane (e.g., a heel strike position) at the heel portion and then increases contact with the ground plane toward the forefoot portion (e.g., a stance position). Unbending of the rod thereby urges the sling and the foot supported therein in a forward direction. The sole may then move from the unflexed state to the flexed state when the heel portion is lifted away from the ground plane toward the forefoot portion and the forefoot portion remains in contact with the ground plane, such as in a toe-off position. Subsequently, the sole may move from the flexed state to the unflexed state when the heel portion is lifted further from the ground plane and the forefoot portion decreases contact with the ground plane, such as by lifting the article of footwear out of contact with the ground plane. Unbending of the rod when moving from the toe-off position to a position completely out of contact with the ground plane urges the sling in a forward direction.

In one embodiment, the article of footwear includes a heel support that extends away from the sole at the heel portion, such as upward from the sole to act as a heel counter. The rod is a first rod that has a first end fixed relative to the heel portion on a medial side of the heel portion, and that extends forward to a second end. The second end pivots relative to the sole when the sole is flexed. The support system further includes a second rod that has a respective first end fixed relative to a lateral side of the heel portion. The first and second rods are in respective first configurations when the sole is in an unflexed state, and elastically deform to respective second configurations bent relative to the first configurations when the sole is in a flexed state.

In this same embodiment, the first and the second rods extend to respective second ends operatively connected to move about a pivot axis that extends laterally at the ground-facing side of the forefoot portion. The sling is further suspended from the second rod at the midfoot portion such that the sling is suspended from the first and second rods on the foot-facing side. The second ends move relative to the pivot axis when the sole moves from the unflexed state to the flexed state.

The support system may include a band that extends from the medial side to the lateral side of the forefoot portion, and that is pivotably connected to the sole at the forefoot portion to pivot at the pivot axis. The second ends of the first and second rods are connected to the band on the foot-facing side of the sole, so that the first and the second rods push the band to pivot about the pivot axis when the sole is moved from the unflexed state to the flexed state. Optionally, the second ends of the first and the second rods can be connected to the band adjacent one another, and can be generally centered over the forefoot region.

The article of footwear may include a plate that extends from the band toward a foremost extent of the sole on the ground-facing side of the sole. The plate pivots with the band about the pivot axis and is thereby urged against a ground plane under the sole when the band pivots forward about the pivot axis.

In one embodiment, the support system has only one rod, the first end of which is fixed on a medial side of the heel support. The support system may further include a pivotable anchor fixed to the medial side of the forefoot portion. The second end of the rod is secured to the pivotable anchor to pivot toward a foremost extent of the sole with the pivotable anchor when the sole is flexed. The article of footwear may further include a shoe upper secured to the heel support and secured to the sole at the forefoot portion. The support system includes a fastening component secured to the lateral side of the shoe upper. The sling is securable to the fastening component such that the sling extends from the rod to the fastening component between the sole and the shoe upper. The fastening component and the sling are configured such that securement of the sling to the fastening component is adjustable, enabling the support provided by the sling at the arch area of a foot to be adjusted. For example, the fastening component may be a first component of a hook-and-loop fastener and a second component of the hook-and-loop fastener can be secured on the sling. The fastening component is secured to the second component when the sling is secured to the fastener. The fastening component is one of hooks and loops, and the second component is the other of hooks and loops. Other suitable fasteners can be used in lieu of a hook-and-loop fastener, such as snaps.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

The above features and advantages and other features and advantages of the present disclosure are readily apparent from the following detailed description of the best modes for carrying out the concepts of the disclosure when taken in connection with the accompanying drawings.

Referring to the drawings, wherein like reference numbers refer to like components throughout the several views, FIG. 1 shows a first embodiment of an article of footwear 10. As further described herein, the article of footwear utilizes a rod support system 12 that supports the foot of a wearer to help ensure a desired or optimal arch position, and utilizes movement and flexing of the foot to help propel the foot forward. As shown in FIG. 1, the article of footwear 10 is an athletic shoe. In other embodiments, the article of footwear 10 could be a dress shoe, a work shoe, a sandal, a slipper, a boot, or any other category of footwear.

Figure 3:
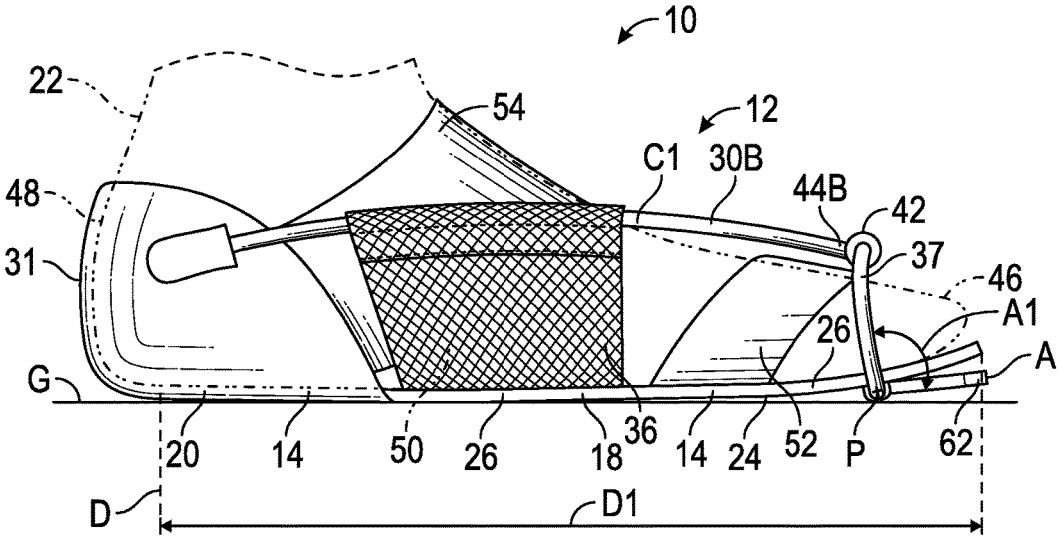
FIG. 3 is a schematic illustration in side view of a lateral side of the article of footwear of FIG. 1 with a sole in an unflexed state and a foot shown in phantom.

More specifically, the article of footwear 10 includes a sole 14 that has a forefoot portion 16, a midfoot portion 18, and a heel portion 20. Although the sole 14 is shown as a unitary component, in alternative embodiments, the sole 14 could be multiple interconnected components, and may include midsole layers and outsole elements. The midfoot portion 18 is between the heel portion 20 and the forefoot portion 16. For purposes of discussion, the heel portion 20, the midfoot portion 18, and the forefoot portion 16 are respectively defined as the rearmost third, the middle third, and the foremost third of the sole 14. Accordingly, the forefoot portion 16 extends from a foremost extent A of the sole 14 to lateral marker B, which is spaced one-third of the way from the foremost extent A to the rearmost extent D of the sole 14 along a longitudinal axis L. The foremost extent A is the forward-most portion of the article of footwear 10 when the article of footwear 10 is in an upright position, as shown in FIG. 1, with the sole 14 positioned under the support system 12. Because the sole 14 is curved at the heel portion 20, the rearmost extent D is defined herein as that portion of the sole 14 that is in contact with the ground plane G when the sole 14 is in the unflexed state as shown in FIG. 3. The rearmost extent D is the rearward-most portion of the article of footwear 10 when the article of footwear 10 is in the upright position. The midfoot portion 18 extends from lateral marker B to lateral marker C, which is spaced two-thirds of the way from the foremost extent A to the rearmost extent D along the longitudinal axis L. The heel portion 20 extends from the lateral marker C to the rearmost extent D.

The heel portion 20 generally includes a region of the sole 14 corresponding with rear portions of a human foot 22, shown in phantom in FIG. 3, including the calcaneus bone and of a size corresponding with the sole 14 and article of footwear 10. Forefoot portion 16 generally includes a region of the sole 14 corresponding with the toes and the joints connecting the metatarsals with the phalanges of the human foot of the size corresponding with the sole 14 and article of footwear 10. Midfoot portion 18 generally includes a region of the sole 14 corresponding with an arch area of the human foot of the size corresponding with the sole 14 and article of footwear 10. A forward direction with respect to the article of footwear 10 is a direction from the heel portion 20 toward the forefoot portion 16 when the article of footwear 10 is in the upright position of FIG. 3, and a rearward direction is a direction from the forefoot portion 16 toward the heel portion 20 when the article of footwear 10 is in the upright position.

Figure 2:
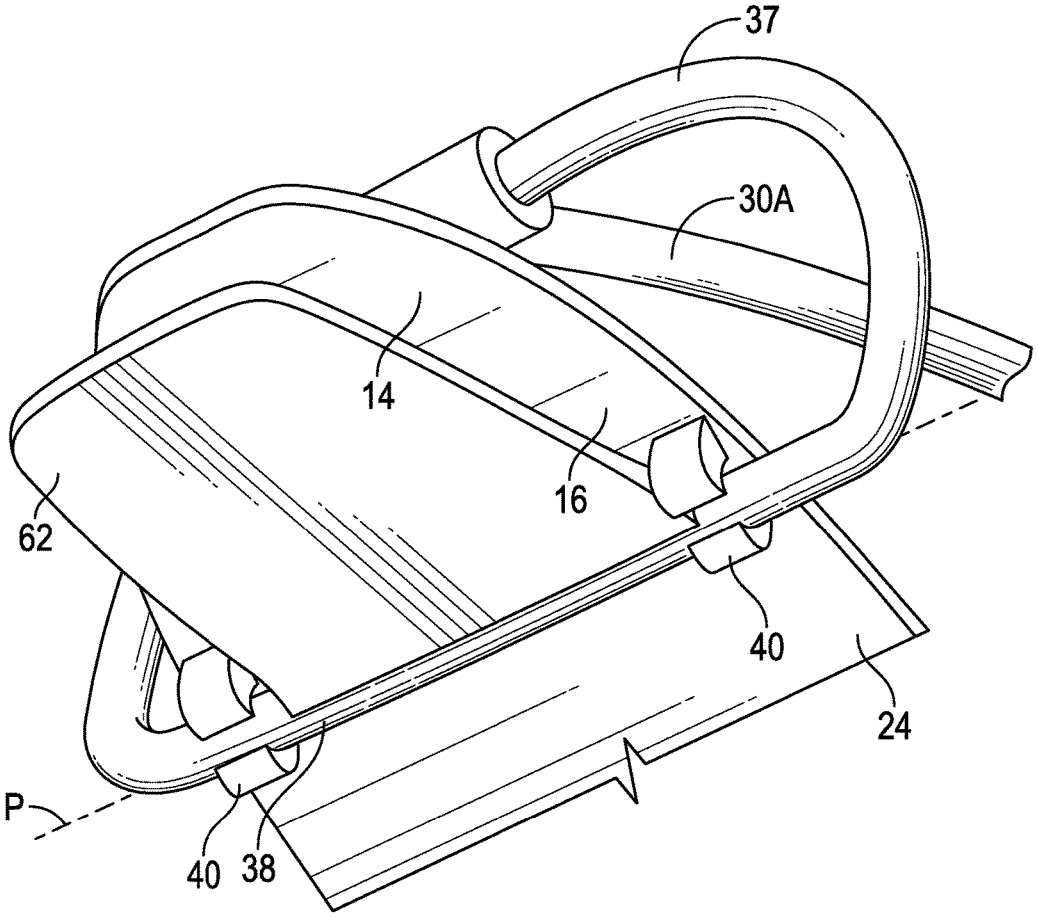
FIG. 2 is a schematic illustration in fragmentary perspective view of a portion of the article of footwear of FIG. 1.

The sole 14 has a ground-facing side 24, indicated in FIGS. 2 and 3, and a foot-facing side 26 opposite the ground-facing side 24 and indicated in FIGS. 1 and 3. The ground-facing side 24 generally faces and makes contact with a ground plane G, as shown in FIG. 3. The foot-facing side 26 generally faces the foot 22 when the article of footwear 10 is worn on the foot 22.

The sole 14 has a lateral side 28 and a medial side 29. As used herein, a lateral side of a component for an article of footwear, such as a lateral side 28, is a side that corresponds with the side of the foot of the wearer of the article of footwear 10 that is generally further from the other foot of the wearer (i.e., the side closer to the fifth toe of the wearer). The fifth toe is commonly referred to as the little toe. A medial side 29 of an article of footwear, such as a medial side 29 of the article of footwear 10, is the side that corresponds with an inside area of the foot of the wearer and is generally closer to the other foot of the wearer (i.e., the side closer to the hallux of the foot of the wearer). The hallux is commonly referred to as the big toe. The lateral side 28 and the medial side 29 both extend from the foremost extent A of the sole 14 to the rearmost extent D of the sole 14.

In the embodiment of FIG. 1, the support system 12 includes a first rod 30A, and a second rod 30B both spaced from the sole 14 and extending longitudinally from the forefoot portion 16 to the heel portion 20 above the foot-facing side 26 of the sole 14. Each of the rods 30A, 30B is operatively connected to the sole 14 at the forefoot portion 16 and at the heel portion 20. The first rod 30A has a first end 32A fixed relative to the heel portion 20 on the medial side 29 of the heel portion 20. The second rod 30B also has a respective first end 32B fixed relative to the heel portion 20 on the lateral side 28 of the heel portion 20. More specifically, a heel support 31 extends upward from the sole 14 to cup the heel of the foot 22. The heel support 31 may be referred to as a heel counter. Anchors 33A, 33B on the medial and lateral sides of the heel support hold the respective first ends 32A, 32B of the rods 30A, 30B. The anchors 33A, 33B are integrally formed with the heel support 31 in the embodiment shown, such as by injection molding. Furthermore, the heel support 31 is integrally formed with the sole 14. In other words, the sole 14, heel support 31, and anchors 32A, 32B are a single, unitary component. In other embodiments, the sole 14 and heel support 31, or the heel support and anchors 32A, 32B, or both, can be separate components rigidly fixed to one another, such as with adhesive or thermal bonding. The first ends 32A, 32B of the rods 30A, 30B are inserted into cavities 35A, 35B within the anchors 32A, 32B and retained therein. For example, the first ends 32A, 32B may be press-fit within the cavities 35A, 35B, or may have enlarged ends that deform upon insertion into the cavities 35A, 35B to help retain the first ends 32A, 32B in the cavities 35A, 35B. Adhesive may be inserted into the cavities 35A, 35B to help retain the ends 32A, 32B upon curing.

The support system 12 also includes a sling 36 suspended from the rods 30A, 30B over the midfoot portion 18 on the foot-facing side 26. The sling 36 can also be referred to as a fascia. The sling 36 fits against the arch area of the foot 22 shown in FIG. 3 and supports the foot 22 above the sole 14. The sling 36 extends laterally between the rods 30A, 30B, and is not secured to the sole 14. In other words, the sling 36 is free to lift relative to the sole 14, as described herein. The sling 36 can be a nylon mesh material, or other suitable material with sufficient flexibility to generally conform to the outer shape of the foot 22 when supporting the arch. The sling 36 has minimal stretch and is of sufficient strength so that, when loaded by the foot 22, its transverse length L2 between the rods 30A, 30B remains relatively constant. As shown in FIG. 1, the sling 36 is looped over each rod 30A, 30B and stitched to itself to suspend from the rods 30A, 30B.

The support system 12 also includes a band 37 that extends from the medial side 29 to the lateral side 28 of the forefoot portion 16. The band 37 may be a loop that is pivotably connected to the sole 14 at the forefoot portion 16 to pivot at the pivot axis P indicated in FIGS. 2-4 as described herein. More specifically, with reference to FIG. 2, the band 37 has a generally straight portion 38 that is captured within tabs 40 that extend generally away from the ground-facing side 24 of the sole 14. The tabs 40 can be integrally formed with the sole 14, such as if the sole 14 is a molded plastic.

Figure 7:
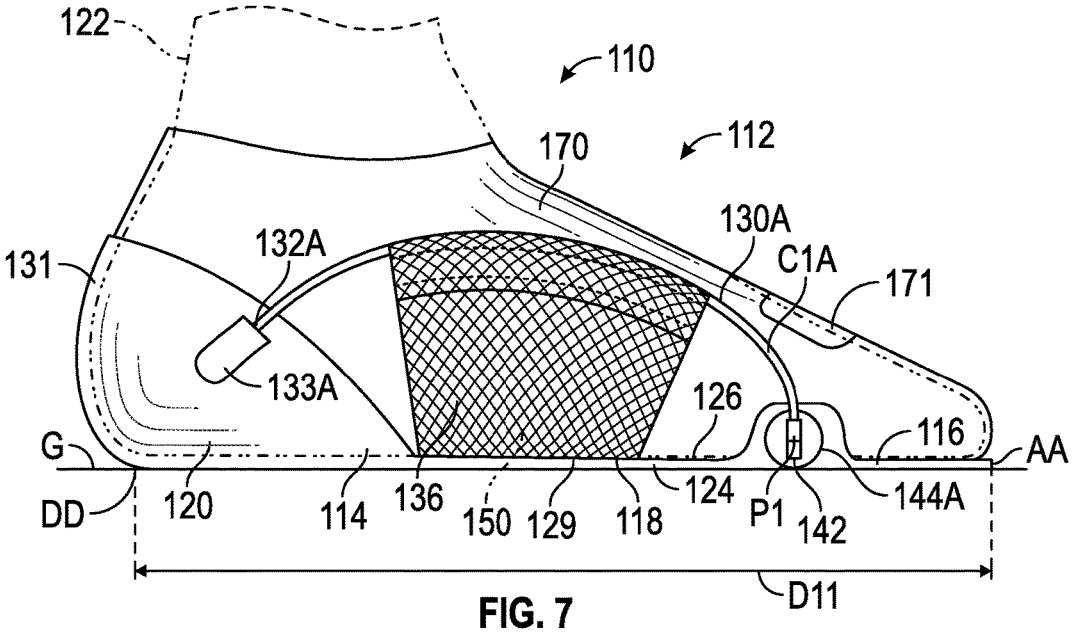
FIG. 7 is a schematic illustration in side view of a medial side of a second embodiment of an article of footwear in an unflexed state with a foot shown in phantom.

Referring again to FIG. 1, the band 37 has an enlarged anchor 42 positioned over the foot-receiving-side 26 of the sole 14. The respective second ends 44A, 44B of the rods 30A, 30B are connected to the anchor 42. Alternatively, the ends 44A, 44B could be attached directly to the band 37 if no anchor 42 is provided. The rods 30A, 30B may be unitary with the anchor 42, such as if the rods 30A, 30B are injection molded with the anchor 42. Alternatively, the second ends 44A, 44B could have enlarged heads that snap into recesses in the anchor 42. In either embodiment, the anchor 42 is fixed to the band 37 and moves with the band 37 but does not rotate relative to the band 37. When the article of footwear 10 is on the foot 22, the band 37 encircles the forefoot 46 with the anchor 42 and the rods 30A, 30B extending above the foot 22 at the forefoot 46 and along side the foot 22 at the heel 48. The second ends 44A, 44B are connected to the band 37 adjacent one another and generally centered over the forefoot portion 16 in the embodiment shown, but could be spaced further from one another or not centered in other embodiments. The sling 36 supports the arch 50. In the embodiment shown, a forefoot strap 52 secured to the sole 14 holds the forefoot 46 against the sole 14, and a rear strap 54 secured to the sole 14 holds the heel 48 against the sole 14 and the heel support 31. The straps 52. 54 are removed in FIG. 1 for clarity. In other embodiments, the straps 52, 54 may be replaced by a full footwear upper, such as shown in the embodiment of FIG. 7. In either case, the sling 36 is not secured to the sole 14 or to the straps 52, 54 or upper and instead is simply supported above the sole 14 and under the foot 22 by the rods 30A, 30B.

The rods 30A, 30B are a generally rigid but elastically deformable material such as a relatively hard plastic or a carbon fiber material. The rods 30A, 30B are formed as substantially straight, elongated rods. The rods 30A, 30B are thus each internally biased toward a straight orientation. Accordingly, when the rods 30A, 30B are bent as the sole 14 is flexed, the kinetic energy required to bend the rods 30A, 30B is stored as potential energy, i.e., spring energy, which is released as the rods 30A, 30B move to a relatively unbent state as the sole 14 is unflexed.

In FIG. 3, the sole 14 is in an unflexed state. For example, when the sole 14 has maximum contact with the ground plane G, such as when the foot 22 is traveling forward and is between a heel strike at the heel portion 20 and a push-off at the forefoot portion 16, the sole 14 is in a first state that is referred to herein as an unflexed state. The rods 30A, 30B are in a corresponding first configuration C1 when the sole 14 is in the unflexed state. Only rod 30B is visible in FIG. 3 in the first configuration C1. Rod 30A is in an identical first configuration C1. It is clear in FIG. 3 that even when the sole 14 is in the unflexed state, the first configuration C1 of the rod 30B is not entirely straight. The rod 30B is bowed slightly upward between the first end 32B and the second end 44B in the first configuration C1.

Figure 4:
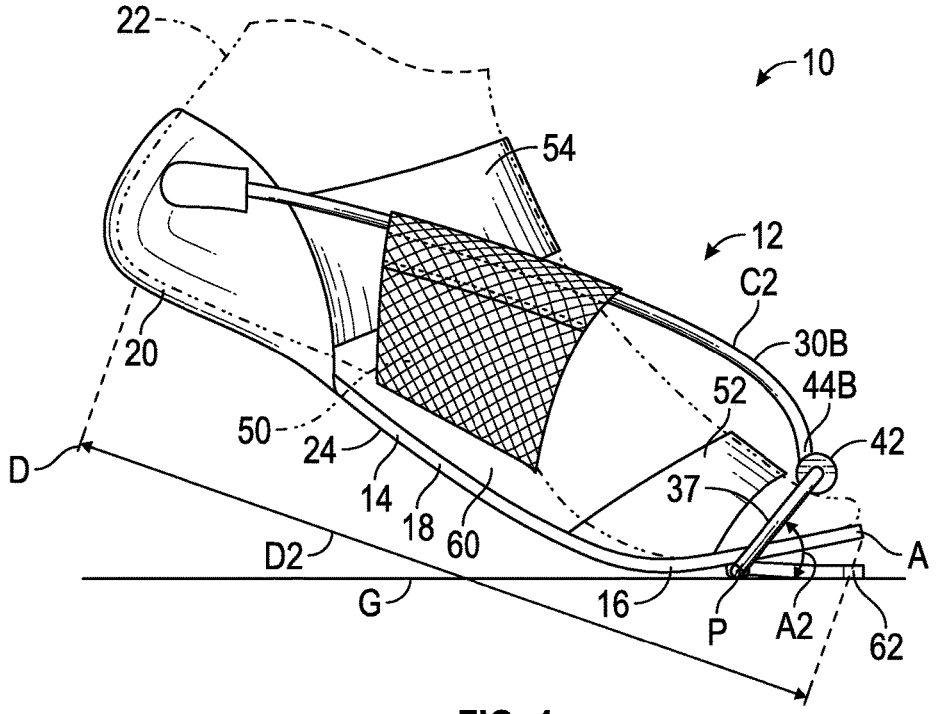
FIG. 4 is a schematic illustration in side view of the article of footwear of FIG. 1 with the sole in a flexed state with a heel portion lifted and a forefoot portion contacting a ground plane in a toe-off position.

When the sole 14 moves from the first, unflexed state of FIG. 3 to a second state, referred to herein as a flexed state and shown in FIG. 4, the heel portion 20 is closer to the forefoot portion 16 on the foot-facing side 26 than in the unflexed state. For example, the distance between the rearmost extent D at the heel portion 20 and the foremost extent A at the forefoot portion 16 is D1 in the unflexed state of FIG. 3, and is shortened to D2 in the flexed state of FIG. 4. This may be referred to as foreshortening of the sole 14 or of the foot 22. Foreshortening of this distance causes the first and the second rods 30A, 30B to elastically deform to a respective second configuration C2 that is bent relative to the first configuration C1. As is apparent in FIG. 4, the rods 30A, 30B are bowed more severely upward in FIG. 4 with the sole 14 in the flexed state. As used herein, the terms "unflexed state" and "flexed state" are relative terms in that the unflexed state of the sole 14 need not be entirely unflexed, but is less flexed than the "flexed state".

As the rods 30A, 30B bend, they move further from the flexed sole 14 at the midfoot portion 18. For example, FIG. 4 shows a gap 60 between the sole 14 and the sling 36. The sling 36 is thus lifted away from the sole 14, and lifts the arch 50 that it supports. Moreover, as the rods 30A, 30B bend, they push the band 37, causing it to pivot forward about the pivot axis P. The respective second ends 44A, 44B of the rods 30A, 30B are operatively connected to move about the pivot axis P. For example, in the view of FIGS. 3 and 4, the band 37 pivots clockwise about the pivot axis P when the rods 30A, 30B move from the first configuration C1 to the second configuration C2, as is illustrated by the band 37 and the second ends 44A, 44B being further forward in FIG. 4 than in FIG. 3. The support system 12 thus moves the arch 50 up and forward relative to the flexing sole 14.

Figure 5:
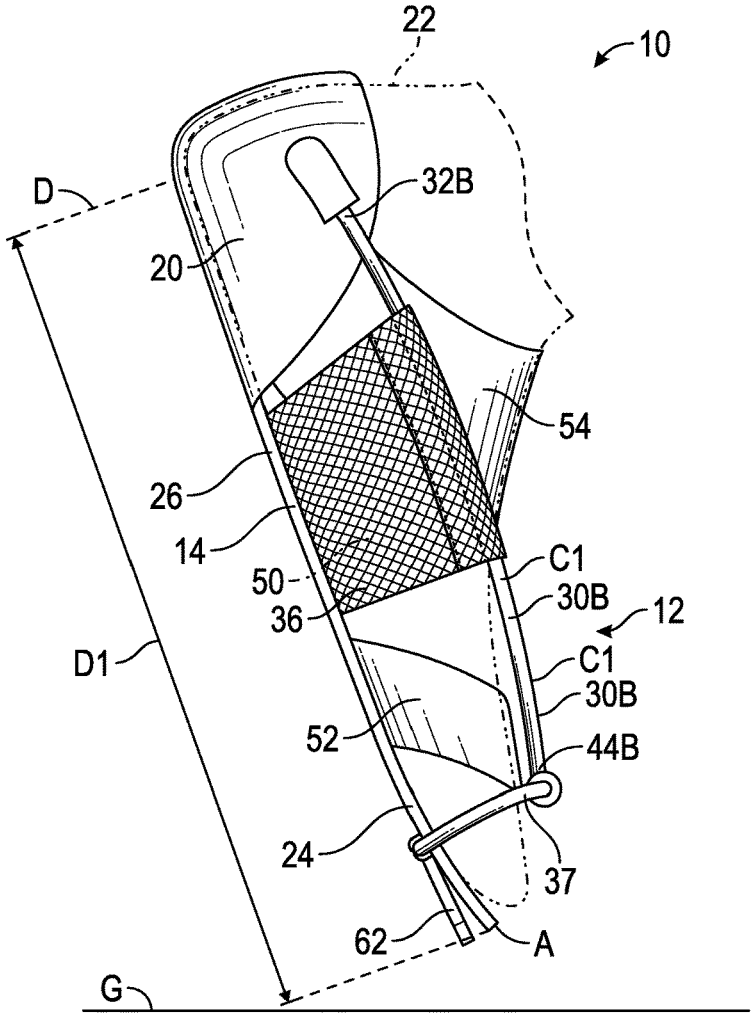
FIG. 5 is a schematic illustration in side view of the article of footwear of FIG. 1 with the sole in an unflexed state and the forefoot portion and heel portion out of contact with a ground plane after completion of toe-off.

Moreover, as the foot 22 completes toe-off and moves forward from the toe-off position of FIG. 4 to the position of FIG. 5, the entire sole 14 is out of contact with the ground plane G, and the sole 14 returns to an unflexed state in which the distance between the foremost extent A of the sole 14 and the rearmost extent D of the sole 14 is again D1. This allows the rods 30A, 30B to return to a first configuration C1 while the foot 22 is in the air, prior to a subsequent heel strike. The stored spring energy in the rods 30A, 30B is thus released as the rods 30A, 30B move to the less bent configuration C1. As the rods 30A, 30B straighten relative to the toe-off position, the first ends 32A, 32B are propelled up and clockwise from their positions in FIG. 4 relative to the second ends 44A, 44B by the releasing spring energy. The sling 36 and arch 50 are thus also propelled up and clockwise. The stored energy in the rods 30A, 30B accomplished by movement of the foot 22 and associated flexing of the sole 14 in FIG. 4 is thus utilized to propel the foot 22 forward when the energy is released in FIG. 5.

Figure 6:
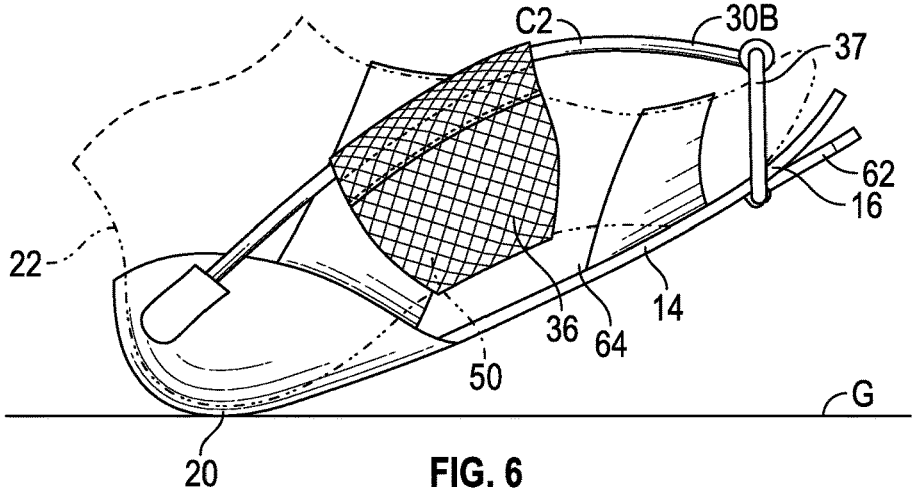
FIG. 6 is a schematic illustration in side view of the article of footwear of FIG. 1 in a flexed state with a heel portion contacting a ground plane.

Following toe-off and movement of the foot 22 forward through the position of FIG. 5, the sole 14 returns to contact the ground plane G, such as with a heel strike, as shown in FIG. 6. In the heel-strike position, the heel portion 20 of the sole 14 is in contact with the ground plane G and the forefoot portion 16 is lifted. The impact of the heel portion 20 with the ground plane G and the flexing of the forefoot portion 16 back toward the heel portion 20 places the sole 14 in a relatively flexed state. The rods 30A, 30B are thus in the second configuration C2, and the sling 36 lifts the arch 50 away from the sole 14 as illustrated with gap 64 similar to gap 60 of FIG. 4. The rods 30A, 30B store spring energy that is released as the sole 14 then moves to the unflexed position of FIG. 3, providing momentum to continue movement of the sole 14 forward.

As an athlete tires, typically, the arch 50 of the foot 22 tends to drop toward the ground plane G relative to the forefoot 46 and the heel 48. With the support system 12, however, the sling 36 prevents or limits such dropping. Moreover, increased loading on the sling 36 also loads the rods 30A, 30B, which can provide even greater bending of the rods 30A, 30B as the sole 14 flexes. Accordingly, any such dropping of the arch 50 contributes to the stored spring energy when the rods 30A, 30B are in the second configuration C2.

As best illustrated in FIG. 2, a plate 62 extends from the band 37 generally toward the foremost extent A of the sole 14 on the ground-facing side 24 of the sole 14. The plate 62 may be integrally formed with the band 37. The plate 62 pivots with the band 37 about the pivot axis P. The bending of the rods 30A, 30B when the sole 14 flexes to the toe-off position of FIG. 4 and pivoting of the band 37 thereby urges the plate 62 against the ground plane G under the sole 14. The force by which the plate 62 is urged against the ground plane G increases traction of the article of footwear 10. The band 37 may continue to rotate forward while the plate 62 cannot as it is against the ground plane G. This causes the angle between the band 37 and the plate 62 to decrease from angle A1 in FIG. 3 to angle A2 in FIG. 4. The plate 62 is biased to a position in which the angle between the plate 62 and the band 37 is A1. Spring energy is stored in the plate 62 by forcing the plate 62 against the ground plane G.

FIGS. 7-10 illustrate another embodiment of an article of footwear 110 that has a rod support system 112. The article of footwear 110 has a sole 114 with a forefoot portion 116, a midfoot portion 118, and a heel portion 120. The sole 114 has a ground-facing side 124 and a foot-facing side 126 opposite the ground-facing side. Like sole 14, the sole 114 is a unitary, one-piece sole, such as an injection-molded component, but could alternatively be comprised of multiple interconnected components. Additionally, a heel support 131 extends away from the sole 14 (e.g., upward from the sole 14) at the heel portion 120. The heel support 131 may be referred to as a heel counter.

A shoe upper 170 is secured to the heel support 131 and to the sole 114 at the forefoot portion 116. The upper 170 can be comprised of multiple separate pieces and materials such as fabric, textiles, leather, plastics, etc. An adjustable strap 171 can be pulled transversely and secured to an anchor 173 to adjust the tightness of the upper 170 at the forefoot portion 116 of the sole 114. A hook and loop fastener, a snap, or other fastener can be secured to and positioned between the strap 171 and anchor 173 to secure the strap 171 to the anchor 172.

The support system 112 includes a rod 130A spaced from the sole 114 and extending longitudinally from the forefoot portion 116 to the heel portion 120 on the foot-facing side 126 as shown in FIG. 7. In contrast to the foot support system 12 of the article of footwear 10, the foot support system 112 includes only a single rod 130A. The rod 130A is on the medial side 129 of the article of footwear 110. The article of footwear 110 is thus for a left foot 122, while the article of footwear 10 of FIG. 1 is shown on a right foot 22.

The rod 130A is operatively connected to the sole 114 at the forefoot portion 116 and at the heel portion 120. More specifically, a first end 132A of the rod 130A is captured in an anchor 133A of the heel support 131. A pivotable anchor 142 is fixed to the medial side 129 of the forefoot portion 116 and is pivotable relative to the sole 114 about pivot axis P1.

A second end 144A of the rod 130A is secured to the pivotable anchor 142 to pivot relative to the sole 114 toward a foremost extent AA of the sole 114 with the pivotable anchor 142 when the sole 114 is flexed. In other words, the rod 130A is in a first configuration C1A when the sole 114 is in a first state shown in FIG. 7, which is a relatively unflexed state. When the sole 114 is in a second state, shown in FIG. 8, which is a relatively flexed state, the rod is in a second configuration C2A that is bent relative to the first configuration C1A.

Figure 9:
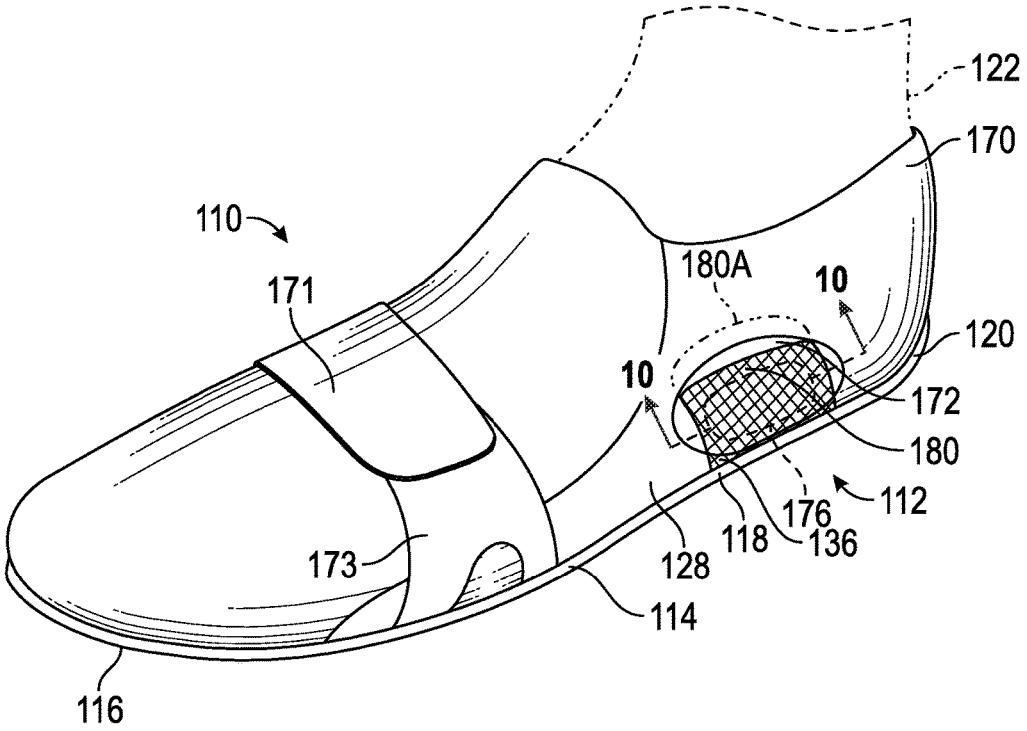
FIG. 9 is a schematic illustration in side view of a lateral side of the article of footwear of FIG. 7.

The support system 112 includes a sling 136 suspended from the rod 130A over the midfoot portion 118. In lieu of a second rod, the support system 112 includes a fastening component 172 secured to the lateral side 128 of the shoe upper 170 as shown in FIG. 9. The sling 136 is securable to the fastening component 172 such that the sling 136 extends from the rod 130A to the fastening component 172 between the sole 114 and the shoe upper 170. The sling 136 is not otherwise secured to the upper 170. This allows the fastening component 172 and the sling 136 to be configured such that securement of the sling 136 to the fastening component 172 is adjustable, allowing a transverse length of the sling 136 between the rod 130A and the fastening component 172 to be adjusted to fit against the arch 150 of the foot 122 to a desired snugness.

Figure 10:
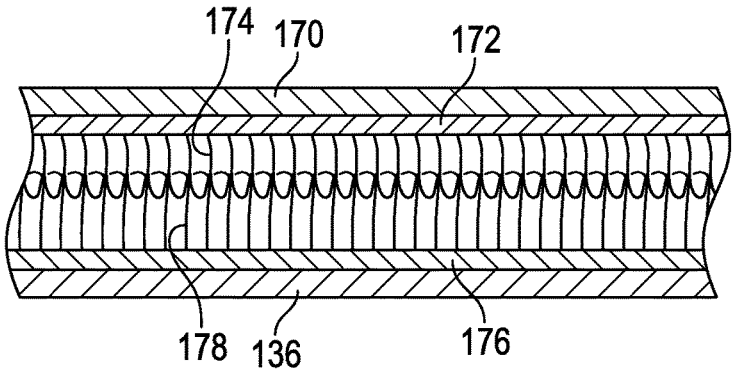
FIG. 10 is a schematic illustration in fragmentary cross-sectional view taken at lines 10-10 in FIG. 9 of a fastener fastening the sling to an upper of the article of footwear.

In the embodiment shown, the fastening component 172 is a first component of a hook-and-loop fastener, and includes loops 174 of polyester or other suitable material, as shown in FIG. 10. A second component 176 of the hook and loop fastener is secured to the sling 136, and include hooks 178 of polyester or other suitable material. The fastening component 172 can be stitched or adhered to the upper 170, and the second component 176 can be stitched or adhered to the sling 136.

Use of the fastening component 172 and the second component 176 allows the transverse length of the sling 136 to be adjusted, such as by pulling the sling 136 further upward on the lateral side 128, as shown by the edge 180 of the sling 136 moved to an adjusted position 180A shown in phantom.

Figure 8:
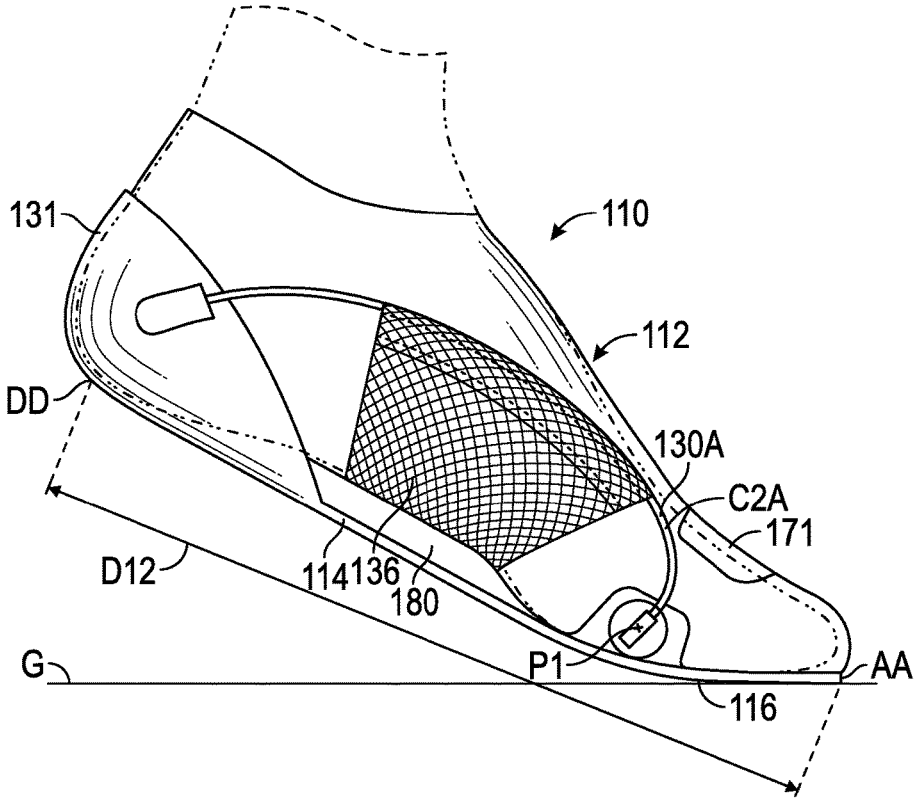
FIG. 8 is a schematic illustration in side view of the article of footwear of FIG. 7 with the sole in a flexed state with a heel portion lifted and a forefoot portion contacting a ground plane.

The rod 130A elastically deforms by bending from the first configuration C1A of FIG. 7 to the second configuration C2A of FIG. 8 when the sole 114 is flexed from the unflexed state of FIG. 7 to the flexed state of the toe-off position of FIG. 8. This lifts the sling 136 away from the sole 114, as illustrated by the gap 180 shown in FIG. 8. A rearmost extent DD of the heel portion 120 of the sole 114 is closer to a foremost extent AA of the forefoot portion 116 of the sole 114 when in the flexed state than when in the unflexed state, as illustrated by distance D12 in FIG. 8 being shorter than distance D11 in FIG. 7. The rod 130A is biased to unbend, to return to the first configuration C1A, releasing stored spring energy when the sole 114 moves from the flexed state shown in FIG. 8 back to an unflexed state, such as when the sole 114 completely leaves the ground plane G after toe-off. The article of footwear 110 will be in a position similar to that of the article of footwear 10 in FIG. 5, with the sole 114 relatively unflexed similar to FIG. 7.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. An article of footwear comprising:

a sole having a forefoot portion, a midfoot portion, and a heel portion; wherein the sole has a ground-facing side and a foot-facing side opposite the ground-facing side; and a support system coupled to the sole, wherein the support system includes:

a rod extending longitudinally from the forefoot portion to the heel portion on the foot-facing side, wherein the rod is coupled to the sole at the forefoot portion and at the heel portion; and a sling coupled to the rod;

a pivotable anchor pivotally coupled to the sole at the forefoot portion, wherein the rod is coupled to the pivotable anchor to pivot relative to the sole with the pivotable anchor when the sole is flexed;

wherein rod has a first end and a second end, the first end of the rod is coupled to the heel portion, and the second end of the rod is pivotally coupled to the forefoot portion;

wherein the second end of the rod pivots relative to the sole when the sole is flexed; and wherein the rod bends when the sole is flexed to thereby lift the sling away from the sole.

2. An article of footwear comprising:

a sole having a forefoot portion, a midfoot portion, and a heel portion, wherein the sole has a ground-facing side and a foot-facing side opposite the ground-facing side; and a support system coupled to the sole, wherein the support system includes:

a rod extending longitudinally from the forefoot portion to the heel portion on the foot-facing side, wherein the rod is coupled to the sole at the forefoot portion and at the heel portion;

a sling coupled to the rod;

a pivotable anchor pivotally coupled to the sole at the forefoot portion, wherein the rod is coupled to the pivotable anchor to pivot relative to the sole with the pivotable anchor when the sole is flexed; and wherein the rod bends when the sole is flexed to thereby lift the sling away from the sole:

a heel support extending away from the sole at the heel portion; and wherein the rod has a first end fixed to the heel support and extends forward to a second end, wherein the second end pivots relative to the sole when the sole is flexed.

3. The article of footwear of claim 2, wherein the second end of the rod is secured to the pivotable anchor to pivot toward a foremost extent of the sole with the pivotable anchor when the sole is flexed.

4. The article of footwear of claim 2, wherein the first end of the rod is fixed on a medial side of the heel support.

5. The article of footwear of claim 2, further comprising:

a shoe upper secured to the heel support and secured to the sole at the forefoot portion;

wherein the support system includes a fastening component secured to a lateral side of the shoe upper; and wherein the sling is securable to the fastening component such that the sling extends from the rod to the fastening component between the sole and the shoe upper.

6. The article of footwear of claim 5, wherein the fastening component and the sling are configured such that securement of the sling to the fastening component is adjustable.

7. The article of footwear of claim 6, wherein the fastening component is a first component of a hook-and-loop fastener; and further comprising:

a second component of a hook-and-loop fastener on the sling; wherein the fastening component is secured to the second component when the sling is secured to the hook-and-loop fastener; and wherein the fastening component is one of hooks and loops, and the second component is the other of hooks and loops.

8. The article of footwear of claim 2, wherein the second end is fixed on a medial side of the forefoot portion.

9. The article of footwear of claim 1, wherein the sling is suspended from the rod over the midfoot portion.

10. The article of footwear of claim 1, wherein the rod is in a first configuration when the sole is in an unflexed state, and elastically deforms to a second configuration bent relative to the first configuration when the sole is in a flexed state with the heel portion closer to the forefoot portion on the foot-facing side than in the unflexed state.

11. An article of footwear comprising:

a sole having a forefoot portion, a midfoot portion, and a heel portion, wherein the sole has a ground-facing side and a foot-facing side opposite the ground-facing side; and a support system coupled to the sole, wherein the support system includes:

a single rod extending longitudinally from the forefoot portion to the heel portion on the foot-facing side, wherein the single rod is coupled to the sole at the forefoot portion and at the heel portion, and the single rod has a first end and a second end, the first end of the single rod is coupled to the heel portion, and the second end of the single rod is pivotally coupled to the forefoot portion; and a sling suspended from the single rod.

12. The article of footwear of claim 11, further comprising:

a pivotable anchor pivotally coupled to the sole at the forefoot portion.

13. The article of footwear of claim 12, wherein the second end of the single rod is directly coupled to the pivotable anchor to pivot toward a foremost extent of the sole with the pivotable anchor when the sole is flexed.

14. The article of footwear of claim 13, further comprising:

a heel support extending away from the sole at the heel portion;

a heel anchor directly coupled to the heel support; and wherein the first end of the single rod is captured by the heel anchor.

15. The article of footwear of claim 14, wherein the first end of the single rod is fixed on a medial side of the heel support.

16. The article of footwear of claim 14, further comprising:

a shoe upper secured to the heel support and secured to the sole at the forefoot portion;

wherein the support system includes a fastening component secured to a lateral side of the shoe upper; and wherein the sling is securable to the fastening component such that the sling extends from the single rod to the fastening component between the sole and the shoe upper.

17. The article of footwear of claim 16, wherein the fastening component and the sling are configured such that securement of the sling to the fastening component is adjustable.

18. The article of footwear of claim 16, wherein the fastening component is a first component of a hook-and-loop fastener; and further comprising:

a second component of a hook-and-loop fastener on the sling; wherein the fastening component is secured to the second component when the sling is secured to the hook-and-loop fastener; and wherein the fastening component is one of hooks and loops, and the second component is the other of hooks and loops.

19. The article of footwear of claim 16, further comprising:

an adjustable strap coupled to the shoe upper, a forefoot anchor coupled to the sole at the forefoot portion; and wherein the adjustable strap is secured to the forefoot anchor to adjust the tightness of the shoe upper at the forefoot portion of the sole.

20. The article of footwear of claim 11, wherein the single rod is in a first configuration when the sole is in an unflexed state, and elastically deforms to a second configuration bent relative to the first configuration when the sole is in a flexed state with the heel portion closer to the forefoot portion on the foot-facing side than in the unflexed state.

* * * * *